US010414624B1

(12) United States Patent
Berry

(10) Patent No.: US 10,414,624 B1
(45) Date of Patent: Sep. 17, 2019

(54) MOTORIZED FLAT WEB WINDER

(71) Applicant: Kevin D. Berry, West Plains, MO (US)

(72) Inventor: Kevin D. Berry, West Plains, MO (US)

( * ) Notice: Subject to any disclaimer, the term of this patent is extended or adjusted under 35 U.S.C. 154(b) by 92 days.

(21) Appl. No.: 15/597,765

(22) Filed: May 17, 2017

Related U.S. Application Data

(63) Continuation-in-part of application No. 14/862,693, filed on Sep. 23, 2015, now Pat. No. 9,676,590.

(60) Provisional application No. 62/053,865, filed on Sep. 23, 2014, provisional application No. 62/337,399, filed on May 17, 2016.

(51) Int. Cl.

| | |
|---|---|
| ***B65H 54/58*** | (2006.01) |
| ***B65H 75/44*** | (2006.01) |
| ***B65H 75/22*** | (2006.01) |
| ***B65H 75/28*** | (2006.01) |
| ***B65H 75/42*** | (2006.01) |
| ***B65H 75/30*** | (2006.01) |

(52) U.S. Cl.
CPC ..... *B65H 54/585* (2013.01); *B65H 75/22* (2013.01); *B65H 75/28* (2013.01); *B65H 75/425* (2013.01); *B65H 75/4486* (2013.01); *B65H 75/30* (2013.01); *B65H 2701/332* (2013.01)

(58) Field of Classification Search
CPC ..... B65H 75/28; B65H 75/30; B65H 75/425; B65H 75/4486; B65H 54/585; B65H 2701/332
See application file for complete search history.

(56) References Cited

U.S. PATENT DOCUMENTS

| | | | | |
|---|---|---|---|---|
| 550,701 A | | 12/1895 | Wardwell, Jr. | 112/232 |
| 1,831,848 A | | 11/1931 | Doney et al. | 242/574 |
| 2,112,606 A | | 3/1938 | Pless | 242/578.2 |
| 2,619,300 A | | 11/1952 | Bartholy | G03D 13/147 |
| 2,663,509 A | | 12/1953 | Hinchman | 242/597.3 |
| 3,124,321 A | * | 3/1964 | Rylott et al. | B65H 54/585 242/397.5 |
| 3,680,807 A | | 8/1972 | Fortson | B21C 47/28 |
| 3,829,034 A | | 8/1974 | Mickelson | 242/597.3 |

(Continued)

FOREIGN PATENT DOCUMENTS

| | | | | |
|---|---|---|---|---|
| GB | 2550895 A | * | 12/2017 | A63C 33/00 |
| WO | WO-2009011642 A1 | * | 1/2009 | B65H 54/585 |

OTHER PUBLICATIONS

Ratchet Strap Winder at www.rhaonline.co.uk/vehicle-security-safety/ext-105-ratchet-strap-winde_-.html Accessed on Sep. 22, 2014.

*Primary Examiner* — William E Dondero
(74) *Attorney, Agent, or Firm* — Jonathan A. Bay

(57) ABSTRACT

A motorized flat web winder has a revolving work holder and a source of drive for turning the revolving work holder. The revolving work holder presents a generally planar support surface. The source of drive turns the revolving work holder about a turning axis. The generally planar support surface cuts the turning axis more or less perpendicularly. The generally planar support surface has a spaced pair of keeper pins extending out from an affixed butt end to a spaced tip end. Preferably, the keeper pins are off-center relative the turning but orbit about the turning axis in a near orbit. More preferably still, the keeper pins orbit the turning axis by a measure which makes either of the brass coupling ends of a fire hose the center of a spiral coil formed therefrom.

6 Claims, 9 Drawing Sheets

(56) References Cited

U.S. PATENT DOCUMENTS 4,057,198 A * 11/1977 Whitfield ..... B65H 54/585 242/403
4,193,560 A 3/1980 Diegel ..... 242/578.2
4,198,010 A * 4/1980 Knapp ..... A62C 33/04 242/403.1
4,240,867 A 12/1980 Diegel ..... 156/543
4,475,698 A * 10/1984 Militello ..... B65H 54/585 242/405.3
5,188,307 A * 2/1993 Miller ..... A62C 33/00 242/405.3
5,388,609 A * 2/1995 Ghio ..... A62C 33/04 137/355.27
5,495,996 A 3/1996 Sakamoto et al. ..... 242/402
5,551,647 A 9/1996 Browning ..... B65H 49/305
6,206,317 B1 * 3/2001 Harvestine ..... B65H 54/585 242/395
6,241,175 B1 * 6/2001 Nichols ..... B65H 54/585 137/355.26
6,622,957 B1 * 9/2003 Fleming ..... A62C 33/00 242/532.6
6,908,060 B2 6/2005 Hibbs ..... 242/578.2
7,766,271 B1 8/2010 Confoey ..... 242/395
2003/0192979 A1 * 10/2003 Olson ..... B65H 54/585 242/395
2004/0056141 A1 3/2004 Quick ..... 242/578
2004/0089761 A1 * 5/2004 Tsao ..... A62C 33/04 242/530.2
2009/0020640 A1 * 1/2009 Johnston ..... A62C 33/00 242/390.8
2009/0166461 A1 * 7/2009 Terrell ..... B65H 54/585 242/364.1
2009/0194628 A1 8/2009 Taylor ..... 242/395
2011/0041458 A1 2/2011 Yu Chen ..... B65B 67/085
2011/0042504 A1 2/2011 Yu Chen ..... B65H 75/241
2011/0049287 A1 3/2011 Yu Chen ..... B65H 75/241
2011/0309182 A1 12/2011 Franchini ..... 242/403.1
2012/0104145 A1 5/2012 Dagley ..... B65H 75/22
2012/0153067 A1 * 6/2012 Motoji ..... A62C 33/04 242/415.1
2013/0119181 A1 5/2013 Fan ..... B65H 75/241
2014/0374528 A1 * 12/2014 Conway ..... A62C 33/02 242/390.8

* cited by examiner

MOTORIZED FLAT WEB WINDER

CROSS-REFERENCE TO PROVISIONAL APPLICATION(S)

This application is a continuation-in-part of U.S. patent application Ser. No. 14/862,693, filed Sep. 23, 2015, which claims the benefit of U.S. Provisional Application No. 62/053,865, filed Sep. 23, 2014.

This application claims the benefit of U.S. Provisional Application No. 62/337,399, filed May 17, 2016.

The foregoing patent disclosures are incorporated herein by this reference thereto.

BACKGROUND AND SUMMARY OF THE INVENTION

The invention relates to winding apparatus and, more particularly, to winding apparatus for winding elongated flexible materials, including without limitation flat-web.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figure 1:
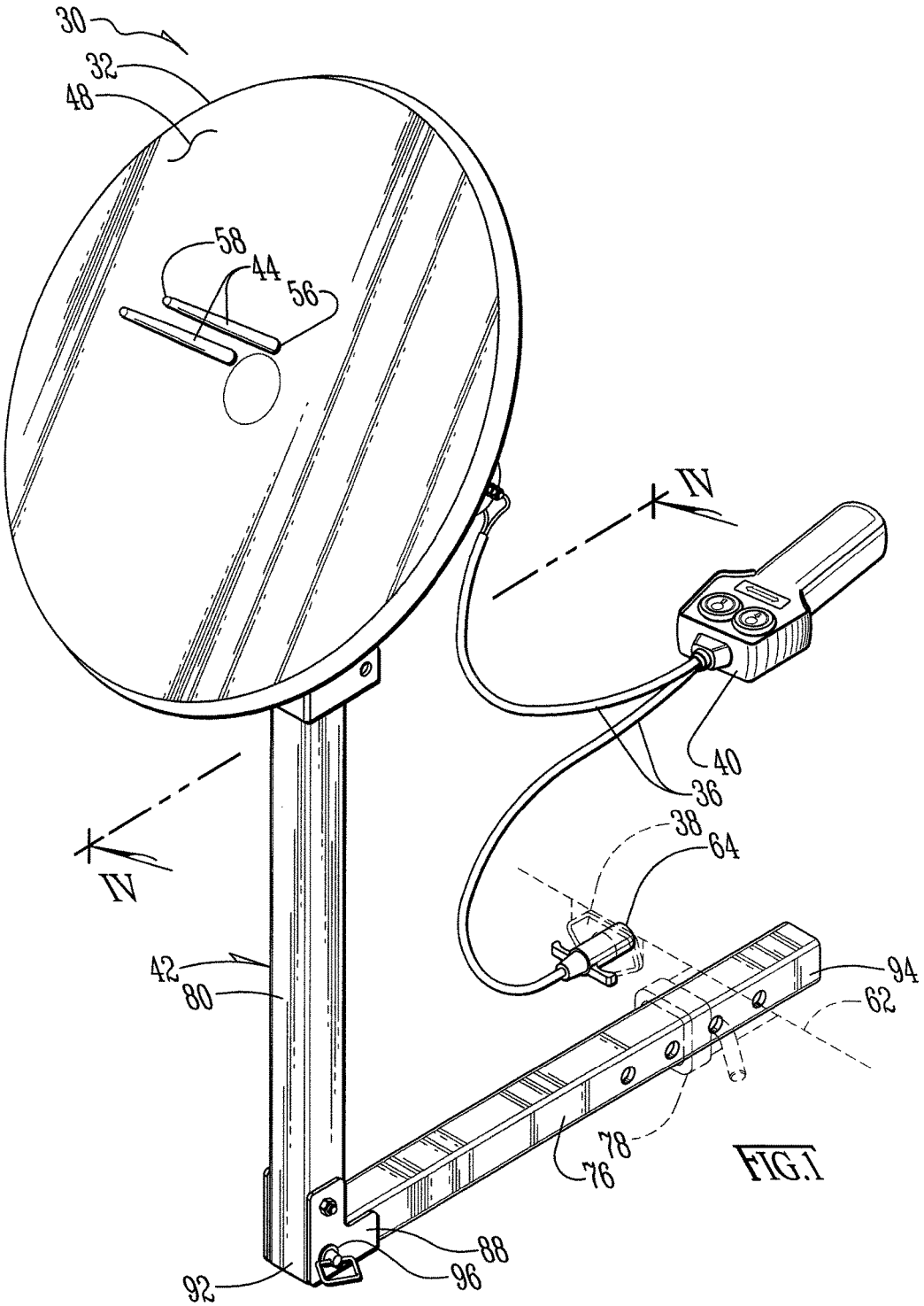
FIG. 1 is a perspective view of motorized flat web winding apparatus in accordance with the invention for a motorized flat web winder in accordance with the invention.
Figure 2:
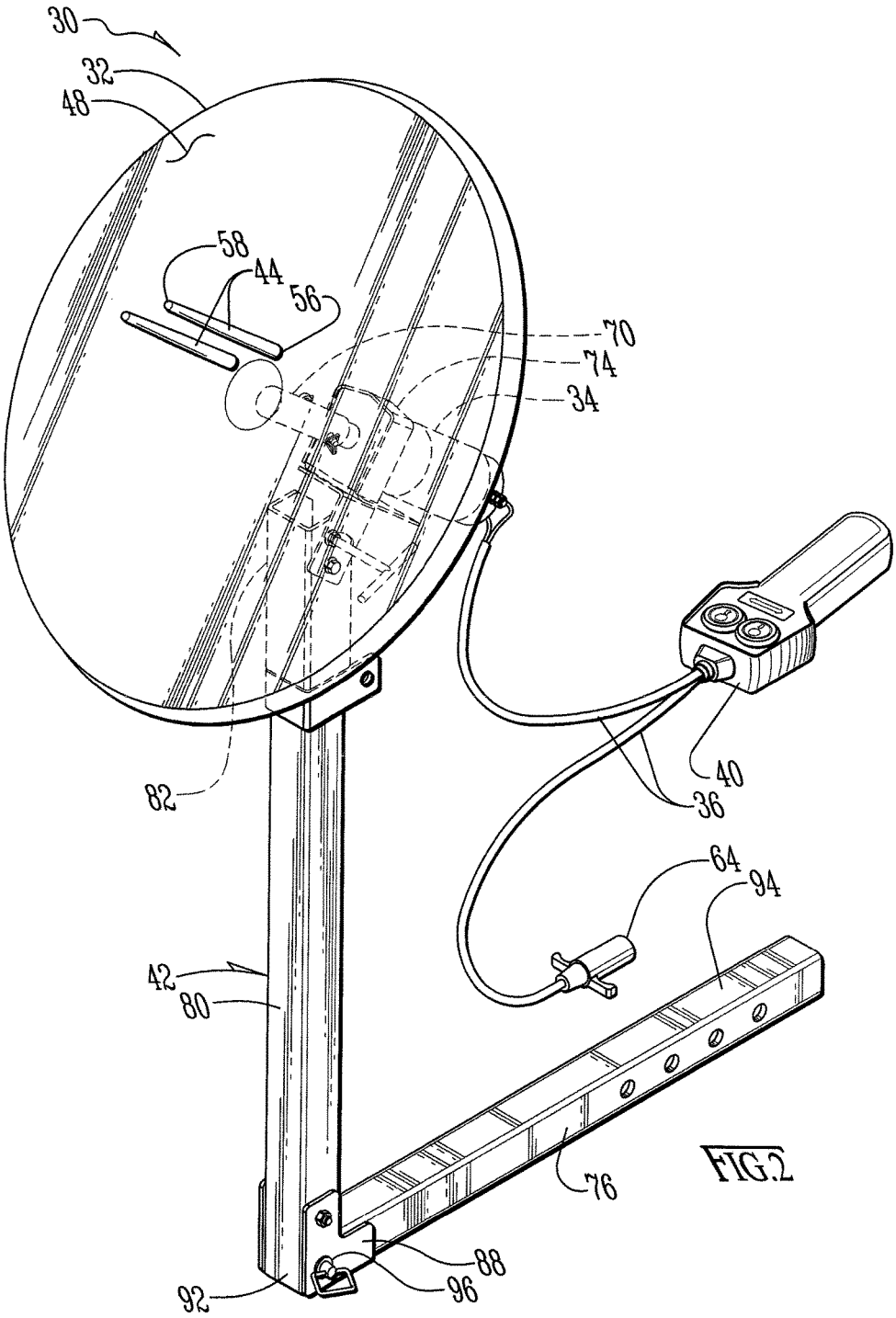
FIG. 2 is a perspective view comparable to FIG. 1 except showing in hidden lines the structure that is hidden from view in FIG. 1 behind the main revolving disk (or table)

FIGS. 1-7 show motorized flat web winding apparatus 30 in accordance with the invention. The motorized flat web winding apparatus 30 comprises a main revolving work holder 32 (or disk), a drive motor 34 to drive the main revolving disk 32, a power line 36 for connecting the drive motor 34 to a source of power 38, a control switch 40, a stand 42, and a pair of spaced keeper pins 44.

The main revolving work holder 32, the keeper pins 44 and the drive motor 34 essentially compose what can referred to as the 'motorized flat web winder' 32, 44 and 34. The rest of the apparatus 30 such as the stand 42 and control switch 40 are not the essence of the motorized flat web winder 32, 44 and 34. That is, the functions of the stand 42 and control switch 40 and so on can be fulfilled in a variety of alternative ways.

Figure 8:
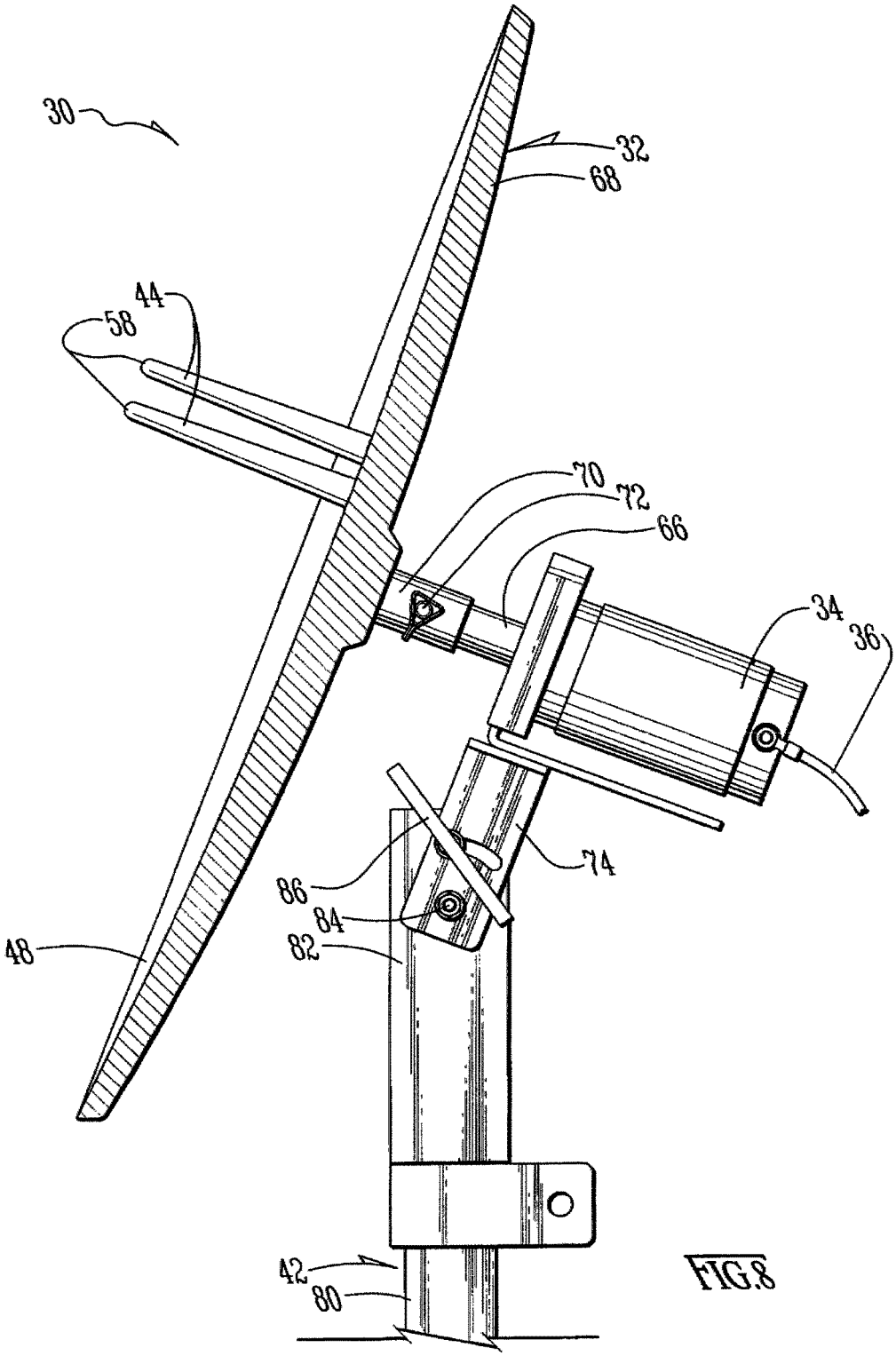
FIG. 8 is a side elevation view comparable to FIG. 4 except partly in section wherein the main support surface is shown, by virtue of a section cut through the main support surface along a vertical plane containing the turning axis, to be preferred if the main support surface is shallowly concave (ie., shallowly dished) symmetrically about the turning axis.
Figure 9:
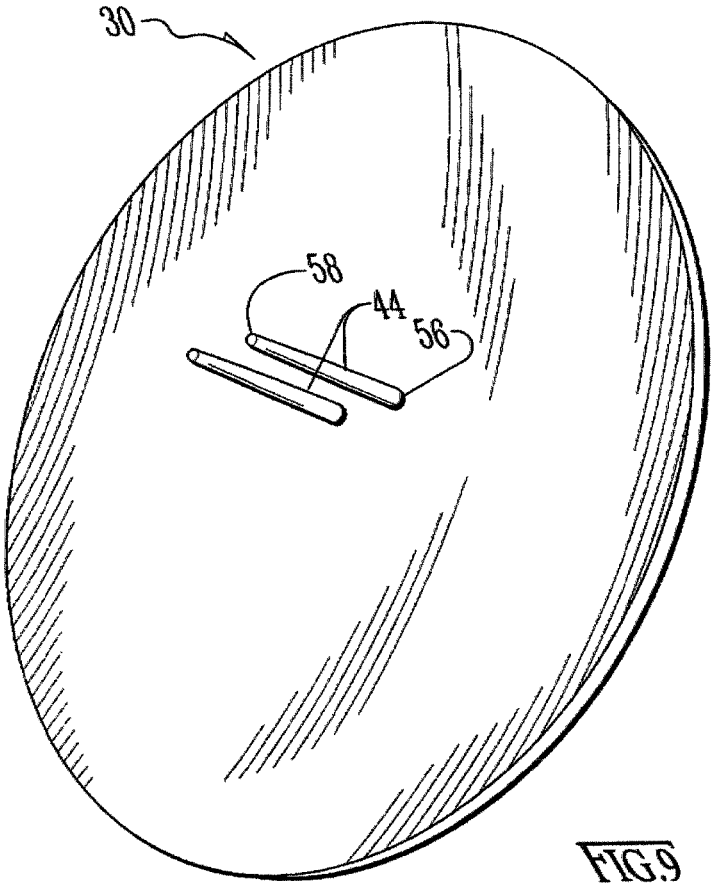
FIG. 9 is a reduced scale perspective view of the FIG. 8 main support surface in isolation.

The main revolving work holder 32 is preferably but without limitation a disk. The main revolving work holder 32 has one relatively expansive surface 48 serving as the main support surface 48. This main support surface 48 generally extends in a plane that cuts the turning axis 50 revolving work holder 32 perpendicularly. The main support surface 48 is generally planar, but it is more preferred still if the main support surface 48 is shallowly concave (ie., shallowly dished) symmetrically about the turning axis 50 (see, eg., FIGS. 8 and 9). The main support surface 48 does not need to be solid, but it is preferred that the main support surface 48 undergirds at least in part the largest diameter of the spiral coil 52 to be formed by the wound-up flat web 54.

The foregoing can be expressed in simpler terms by means of a non-limiting example. The principal problem the invention intends to solve is winding up firefighters' fire hose 54, and do so both rapidly and neatly. The inventor hereof has several years experience with firefighting wildfires in California during some of the severest drought periods. He relates that, after the effort of combating a widespread wildfire is finished/called-off, there are perhaps 1,000's of strewn fire hoses scattered across the landscape and perhaps over several square miles that should be collected and coiled back up for a subsequent use.

So, for the purpose of winding up tossed-aside fire hose 54, the inventor chose that the main support surface 48 should be sized to support a fully wound up fire hose 54 that is less than three and one-half feet (N one meter) in diameter. A subsequent design choice was that the main revolving work holder 32 would define without limitation a circular main support surface 48. However, this does not exclude and without limitation a main work support surface 48 comprised of three spokes, or four spokes or more, a grill network and so on.

The pair of spaced keeper pins 44 project out from the main support surface 48 from an affixed butt end 56 to a free tip end 58. The keeper pins 44 are preferably tapered, being wider at the butt end 56 and narrower at the tip end 58. The keeper pins 44 are preferably longer than the width of the flat web 54 that is to be wound. More preferably still, the keeper pins 44 are two to three times or more longer than the width of the flat web 54 that is to be wound.

The keeper pins 44 are relatively closely spaced. At minimum the keeper pins 44 have to be spaced apart at least by the thinnest thickness of the flat web 54 that is to be wound. However, there are good reasons why to space the keeper pins 44 apart much more than that, and more like the measure of the width of the flat web 54 that is to be wound. Let's return to the example of fire hose 54.

Exemplary fire hose 54, when dry inside and out, and flattened to its flattest, has about the following measurements. If the fire hose 54 is two and one-half inches (~six cm) in diameter, it will have a flattened width of somewhere in the neighborhood of three and one-half inches (~nine cm) and a thickness surely less than an inch (N two and one-half cm). So one design choice is to keep the spacing of the keeper pins 44 to about the thickness of the flattened web 54.

However, used fire hose 54 tossed aside after lengthy service combating a wildfire is anything but flat and smooth. It will have kinks and abrasions, and, all kinds of other insults from being pulled past all manner of sharp rocks and then in harms way of fire and/or embers. Thus another design choice is to space the keeper pins 44 apart by the nominal diameter of the flat web 54 to be wound. That way, a deformed fire hose 54 will partly return to a more relatively normal flattened state by passing through the keeper pins 44, and furthermore return (as much as possible) to a flattened state when "like new" by coiling on top of the previous ring of the coil 52 below the newly forming ring, and then, being compressed by a later ring of the coil 52 forming on top of it.

The keeper pins 44 are located not only close to each other but also close to the turning axis 50. Preferably at least one of the keeper pins 44 is not located on the turning axis 50. More preferably still both keeper pins 44 are not located on the turning axis 50 and instead, orbit the turning axis 50 on the same diameter. The spacing of the orbit diameter is selected by reasons of design preference to accommodate one or the other of the couplers 60 at the ends of the fire hose 54. That is, the fire hose 54 is essentially a collapsible hose with rigid couplers 60 at each end, typically produced from brass or a brass alloy. So if it is preferred that the female coupler is consistently placed at the center of the coil 52, then the spacing of the keeper pins 44 from the turning axis 50 is chosen so that the whole fire hose 54 is coiled symmetrically about the female coupler. And, with the female coupler occupying the center of the coil 52, that symmetry should not distort the coil 52 into an oval or tear drop shape.

Preferably the drive motor 34 is not only electric but also a 12 VDC electric drive motor 34. Actually, it is preferred that the drive motor 34 can be powered off the vehicle batteries that are going to tow this motorized flat web winding apparatus 30 in accordance with the invention around the landscape to retrieve spent fire hose 54 after a wildfire. So if the vehicle 62 is 24 VDC, then preferably the drive motor 34 is also 24 VDC, or else there is an intervening converter to convert the vehicle voltage to the drive motor voltage.

FIG. 1 shows that the drive motor 34 is connected by an electric line 36 to the electric outlet 38 for trailer lights (and/or brakes in some cases) on the rear of a vehicle 62. It is presumed that the preferred design will have an electric line 36 with an 7-blade RV plug 64 for plugging the RV outlet 38 on the rear of a utility truck 62 or the like.

The motor 34 turns a drive shaft 66. The drive shaft 66 turns coaxially on the same turning axis 50 as for the main revolving disk 32 in accordance with the invention (ie., there is no gearing or other transmission as such being unnecessary if the motor 34 turns slow enough).

The main revolving disk 32 has a back side 68. Projecting off the back side 68 is a socket 70 for receiving the drive shaft 66, which are pinned together by a pin 72 such as a clevis pin, or more particularly and without limitation, a round head wire lock pin. The purpose of the pin 72 is so that the main revolving disk 32 can be readily disassembled and reassembled after travel and storage in the utility truck 62 between uses.

Figure 3:
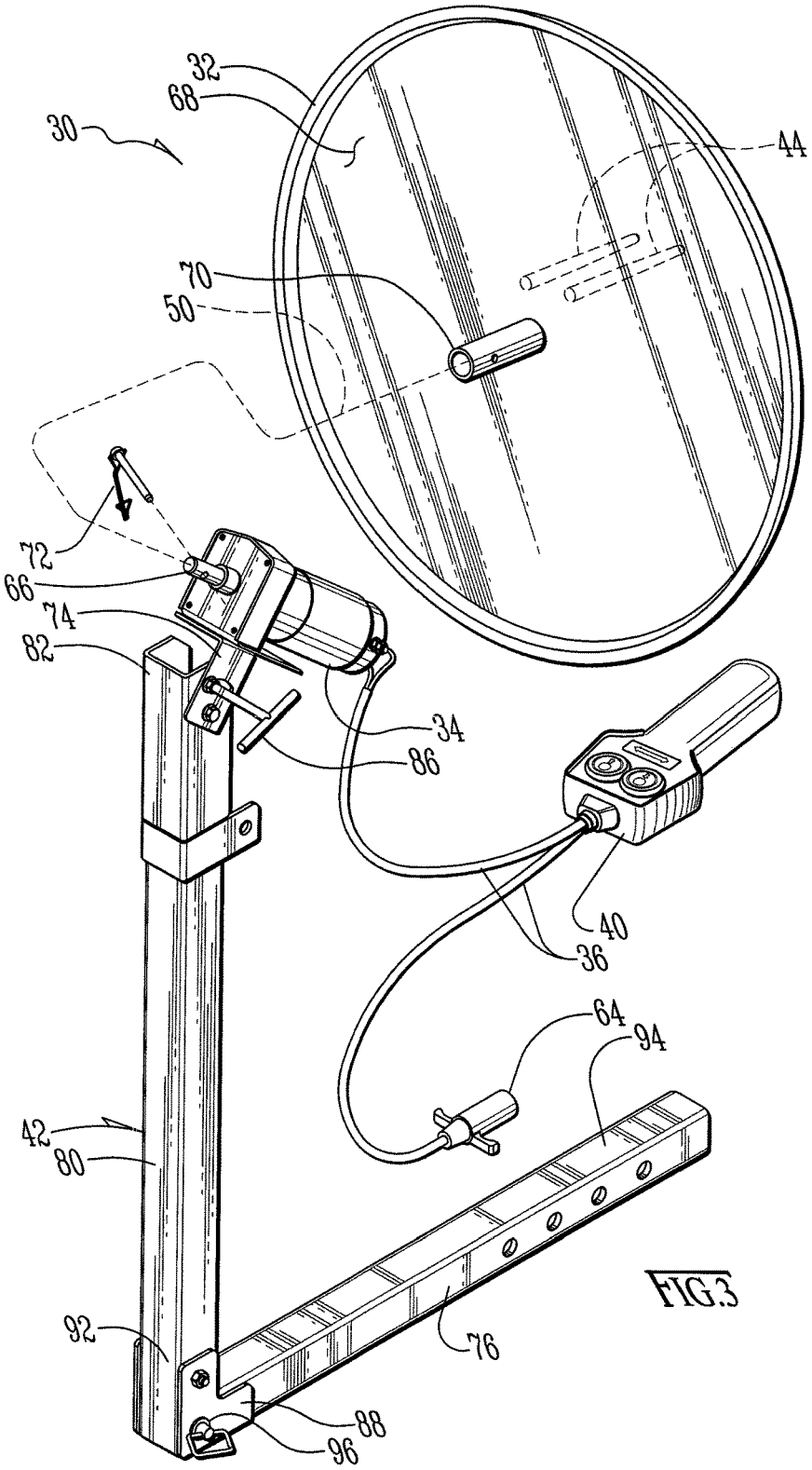
FIG. 3 is a perspective view comparable to FIGS. 1 and 2 except with the main revolving disk uncoupled from the drive shaft of the electric motor.
Figure 4:
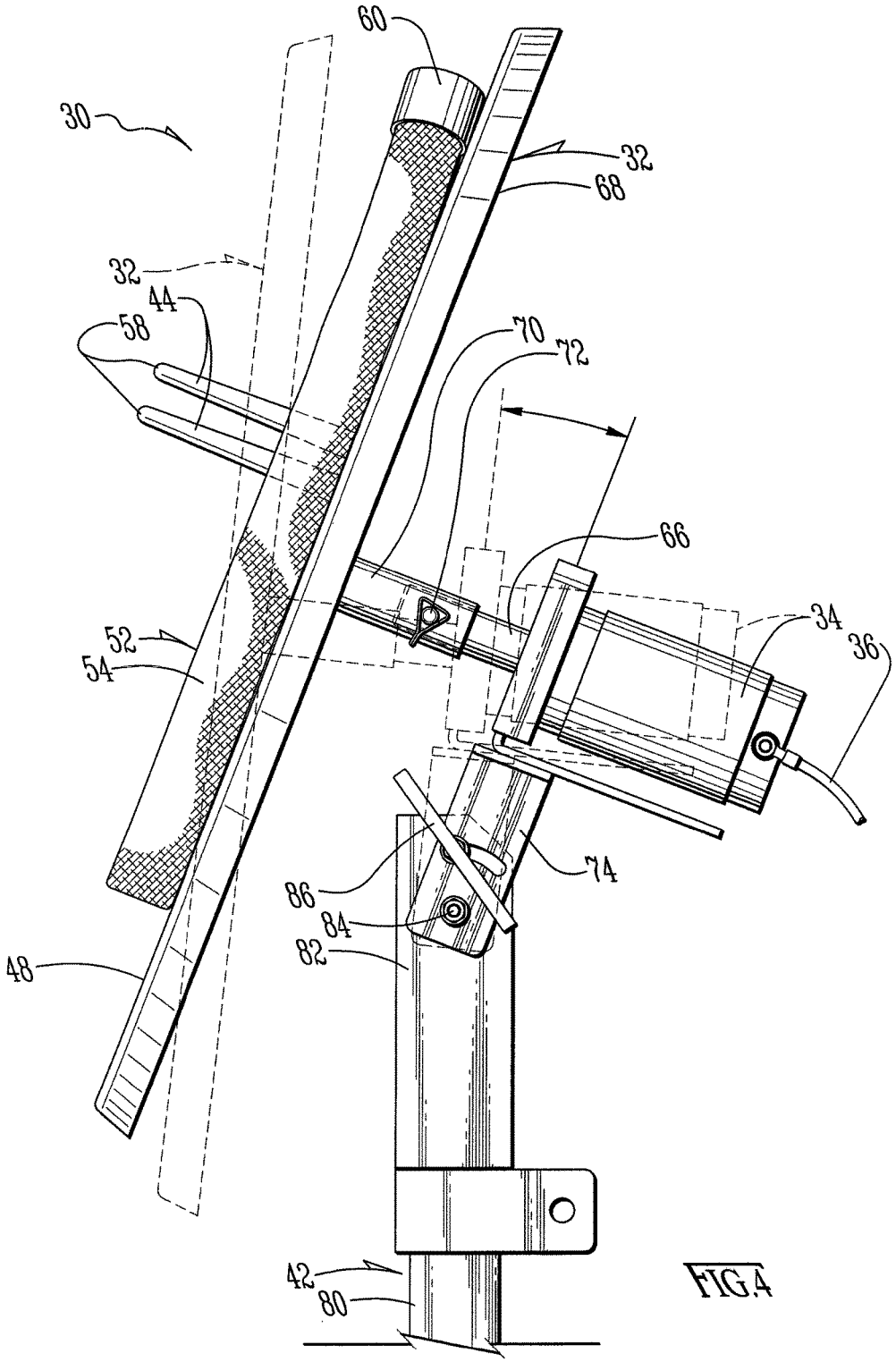
FIG. 4 is an enlarged-scale side elevation view taken in the direction of arrows IV-IV in FIG. 1.

FIGS. 3 and 4 shows better that the electric motor 34 is mounted on a bracket 74 on top of an L-shaped stand 42.

FIG. 1 shows that the L-shaped stand 42 has a horizontal foot 76 for insertion in the square hitch receiver 78 of the utility truck 62. FIG. 3 furthermore shows that the L-shaped stand 42 has a vertical leg 80 that terminates in a top end 82 that supports the bracket 74 that carries the drive motor 34. The bracket 74 is connected to the top end 82 of the vertical leg 80 by (1) a pivot fastener 84 and (2) a manually-tightened locking fastener 86. The manually-tightened locking fastener 86 can have a T-handle or the like, and extends through an arcuate slot in the bracket 74, which arcuate slot has a center of geometry coaxial with the axis 50 of the pivot fastener 84. That way, as FIG. 4 shows better, the main support surface 48 of main revolving disk 32 can be adjusted among a variety of angles including vertical, but more preferably to an oblique angle including without limitation where the turning axis 50 of the drive shaft 66 is about 15° from horizontal. This is shown solid lines in FIG. 4. When the drive shaft 66 of the motor 34 is oriented at about 15° to horizontal, the plane of the main support surface 48 of the revolving disk 32 is tilted to about 75° to horizontal.

Figure 5:
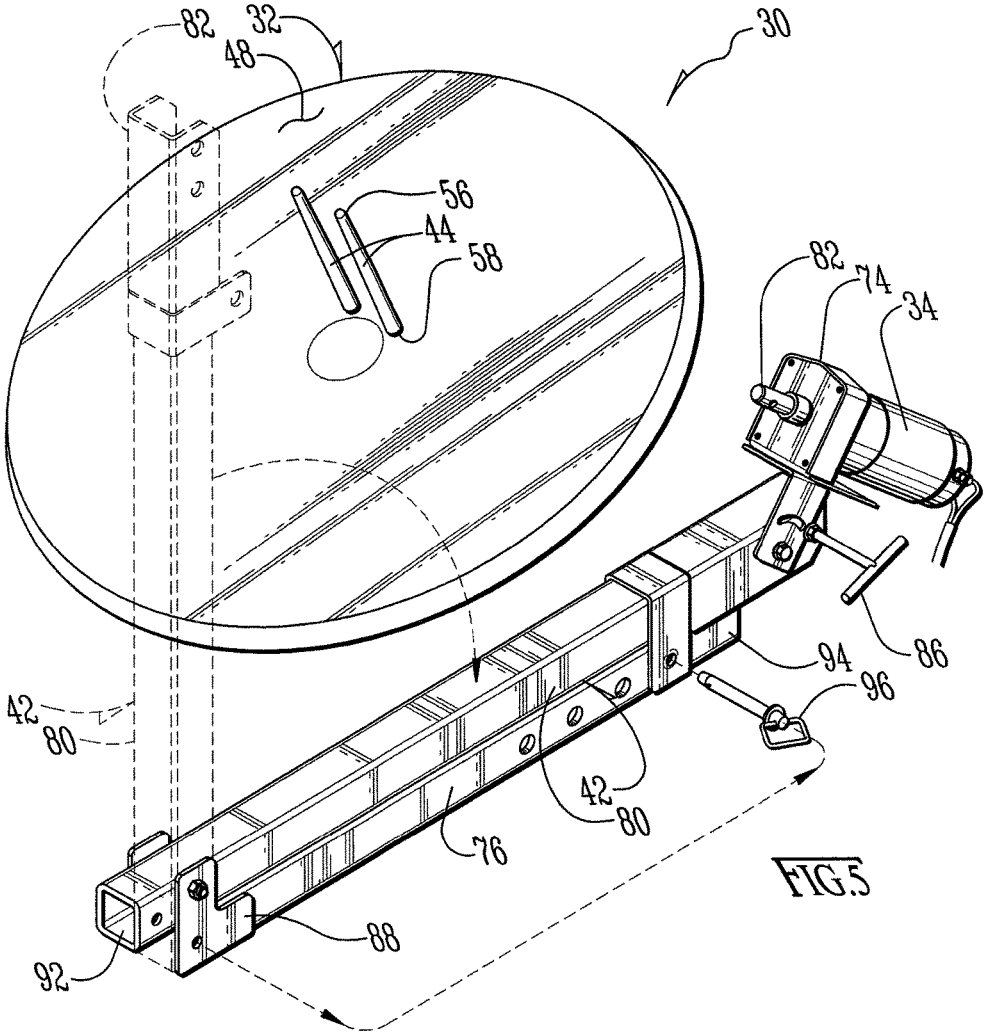
FIG. 5 is a perspective view comparable to FIG. 3 except showing that the L-shaped stand folds into a collapsed state at a pivoted connection between the leg and the foot.

FIG. 5 shows that the foot 76 and the leg 80 of the L-shaped stand 42 are produced of square tube and are joined by a pair of flat corner brackets 88. The bottom end 92 of the leg tube 80 is bolted between the flat corner brackets 88. In contrast, the rear end 94 of the foot tube 76 is merely pinned between the flat corner brackets 88 by a removable pin 96 such as any manner of clevis pin. That way, the L-shaped stand 42 can be folded down into a collapsed state for portability, or unfolded into a deployed state when removable pin 96 is locking the pivoting joint in the fixed L-shaped position as shown in FIG. 6.

Figure 6:
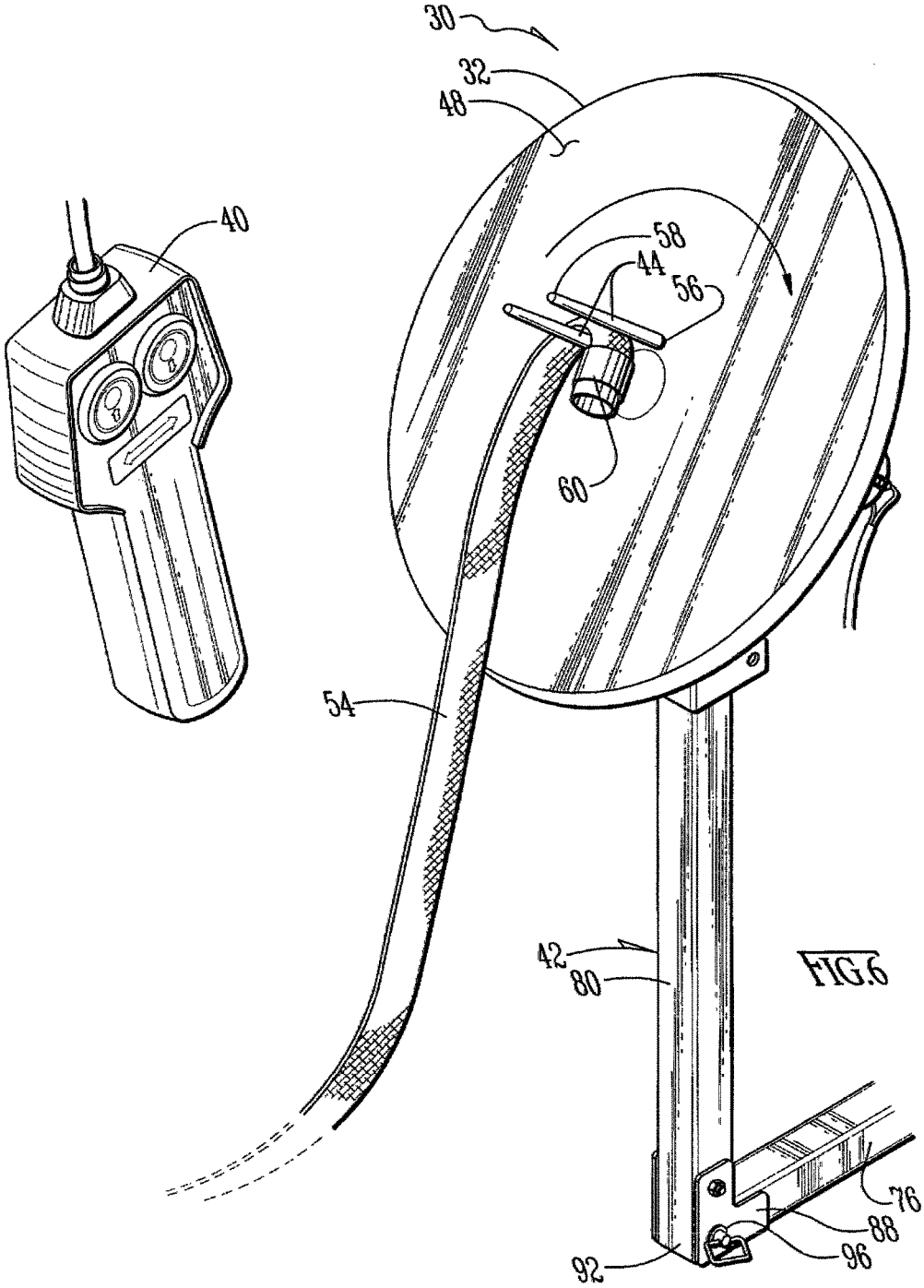
FIG. 6 is a perspective view comparable to FIG. 1 except showing the tag end (or at least one end) of an elongated flat web (such as and without limitation a fire-fighter's fire hose) being threaded between a spaced pair of tapered keeper pins sticking out of the main revolving disk.

To turn to FIG. 6, it shows a manual control switch 40 for controlling the drive functions of the electric drive motor 34. The control switch 40 provides controls for OFF, and ON turning clockwise as well as ON turning counterclockwise, and then also, rate of speed too. Again, the manual control switch 40 has not only OFF and ON functions, but speed control and turning direction control.

In FIG. 6, the tag end 60 (or at least one end) of the elongated flat web 54 (eg., fire hose 54) is inserted between the spaced pair of tapered keeper pins 44 of the main revolving disk 32. The chosen tag end 60 for fire hose 54 is the brass coupling 60 for either the female or the male end. The female end is shown here. Again, preferably the main support surface 48 of the revolving disk 32 is inclined to an oblique angle, for example and without limitation, to a tilt to about 75° to horizontal. That way, the rings of the coil 52 tend to lay flat on the main support surface 48 while also orienting the revolving disk 32 to near vertical, which is more comfortable angle for the user to hand feed fire hose 54 to the revolving disk 32 for fire hose 54 laying on the ground.

In other words, the user is hand supporting the fire hose 54 as it is being wound in rings of a coil 52. The user is also looking backwards to anticipate twists or knots in the fire hose 54, to unravel those too before being wound into the coil 52.

Figure 7:
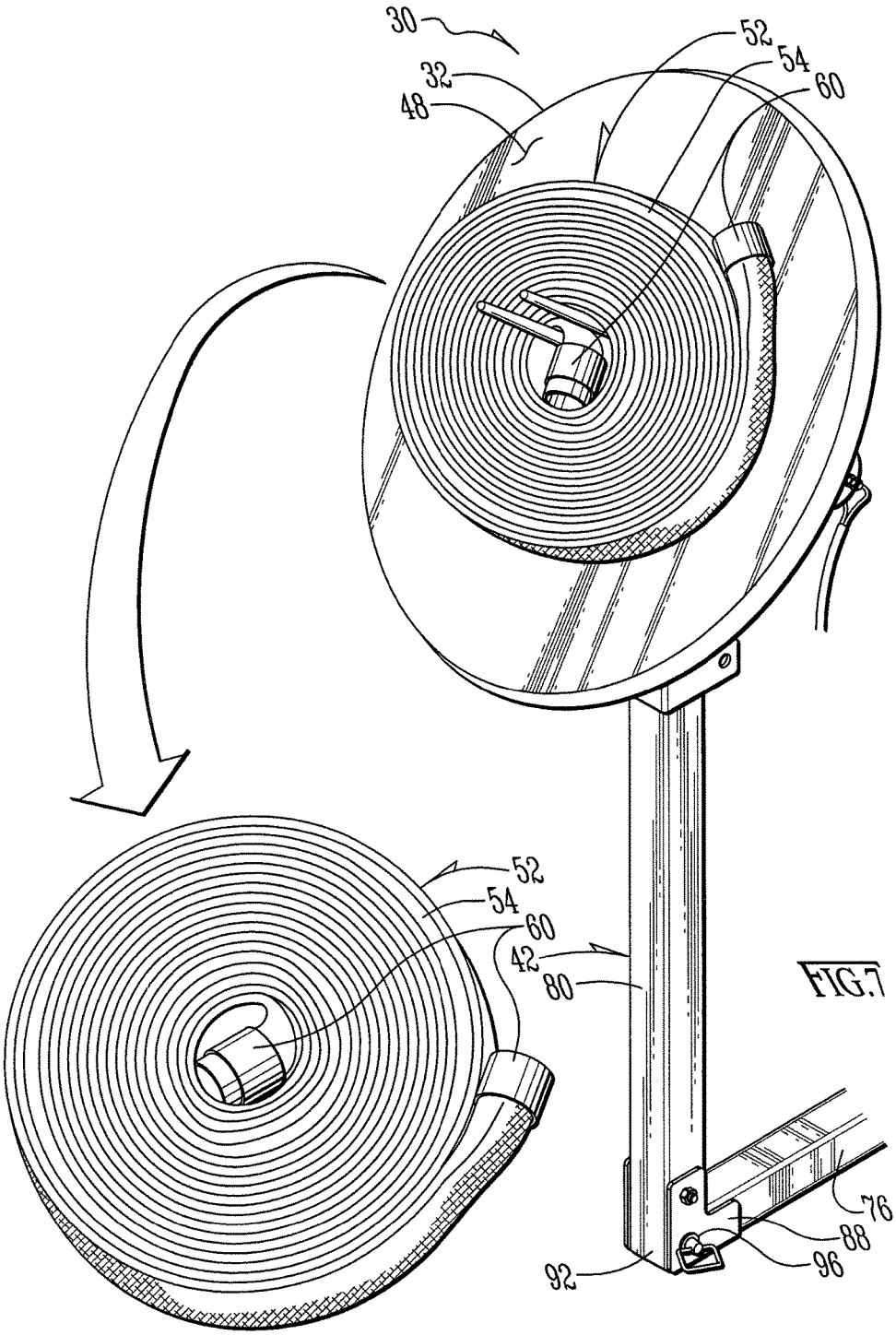
FIG. 7 is a perspective view comparable to FIG. 6 except showing completion of the winding of the flat web into a compact spiral coil and subsequent easy removal of the spiral coil off the tapered keeper pins.

FIG. 7 shows completion of the winding of the elongated flat web 54 into a compact spiral coil 52. The keeper pins 44 orbit around the turning axis 50 of the revolving disk 32, winding the flat web 54 in a coil 52 with the coupling 60 of the inner tag end 60 trapped from pulling free but also relatively centered on the turning axis 50. As a result, a relatively circular coil 52 forms, rather than a distorted coil.

Again, the keeper pins 44 are tapered from the wider butt end 56 to the narrower tip end 58. That way, the wound-up spiral coil 52 of the elongated flat web 54 slides easily off the tapered pins 44 as shown in FIG. 7.

Thus FIG. 7 shows the end-result of the motorized flat web winder 32, 44 and 34 in accordance with the invention, namely, a compact spiral coil 52 of a fully wound-up flat web 54 (eg., a fire hose 54) ready for storage until a next use.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A motorized flat web winder, comprising:

a revolving work holder presenting a support surface;

a drive shaft affixed to and turning the revolving work holder about a turning axis;

a source of drive for the drive shaft; and a spaced pair of keeper pins extending out of the support surface from an affixed butt end to a spaced tip end, at least one of which pins is off-center relative the turning axis of the revolving work holder;

wherein the support surface is shallowly concave.

2. The motorized flat web winder of claim 1, wherein:

both keeper pins are off-center but in a near orbit about the turning axis of the revolving work holder.

3. The motorized flat web winder of claim 2, wherein:

the keeper pins are tapered such that the butt end is wider and the tip end is narrower.

4. The motorized flat web winder of claim 1, wherein:

the keeper pins are tapered such that the butt end is wider and the tip end is narrower.

5. The motorized flat web winder of claim 4 wherein:

the support surface cuts the turning axis perpendicularly; and the revolving work holder is disposed such the turning axis is oriented at about 15° to horizontal such that the plane of the support surface is tilted to about 75° to horizontal.

6. The motorized flat web winder of claim 5, wherein:

the tilt of the support surface is adjustable to include vertical.

* * * * *